United States Patent [19]

Buehler

[11] Patent Number: 4,952,551

[45] Date of Patent: Aug. 28, 1990

[54] COPY FORM SET

[76] Inventor: Walter Buehler, Edelweissring 38, D-8901 Koenigsbrunn, Fed. Rep. of Germany

[21] Appl. No.: 178,128

[22] Filed: Apr. 6, 1988

[30] Foreign Application Priority Data

Apr. 10, 1987 [DE] Fed. Rep. of Germany ... 8705322[U]

[51] Int. Cl.[5] ..... B41M 5/22

[52] U.S. Cl. ..... 503/204; 427/152; 428/195; 428/207; 428/484; 428/488.1; 428/914; 503/206; 503/226

[58] Field of Search ..... 427/150–152; 428/195, 488.4, 913, 321.5, 207, 484, 488.1; 503/204, 226, 206

[56] References Cited

U.S. PATENT DOCUMENTS

| | | | |
|---|---|---|---|
| 4,162,165 | 7/1979 | Schwab | 106/21 |
| 4,404,251 | 9/1983 | Jabs et al. | 106/21 |
| 4,662,651 | 5/1987 | Mowsy | 283/70 |

FOREIGN PATENT DOCUMENTS

| | | | |
|---|---|---|---|
| 0096891 | 6/1982 | Japan | 503/204 |
| 0133095 | 8/1982 | Japan | 503/204 |

*Primary Examiner*—Bruce H. Hess
*Attorney, Agent, or Firm*—Krass & Young

[57] ABSTRACT

The lower side of a transmitter sheet (1) of a copy form set of chemically reacting color reaction paper provided with a CB coating (2) is zonewise provided with an additional ink layer (4) e.g. on wax basis. On writing or printing upon the copy form set within the intensification zone (3) defined by the additional ink layer (4) the color pigments of the additional ink layer (4) are partially or completely dissolved by means of the CB substances of the CB coating and transmitted to the CF coating (5) of the receiver sheet (6). This results in that the copy is itensified within the area of the intensification zone (3), thus becoming particularly machine-readable.

13 Claims, 1 Drawing Sheet

COPY FORM SET

BACKGROUND OF THE INVENTION

The present invention relates to a copy form set which comprises, optionally besides other sheets, a transmitter sheet whose transmitter side is provided with a layer of microencapsulated dye precursors (CB substances), as well as a receiver sheet whose receiver side facing the transmitter side of the transmitter sheet is provided with color-developing adsorbing substances. Further, the invention relates to a transmitter sheet especially for copy form sets of the above kind.

Self-copying papers on the basis of chemical dye reactions (so-called CFR papers) have been known for a long time and are used for various purposes. Form sets of color reaction papers are often composed in that a layer which delivers mostly microencapsulated dye precursors is arranged on the reverse of a transmitter sheet. The delivering layer consists of so-called CB (coated back) substances which contain high-boiling mixtures of solvents, in which various weakly colored dye precursors are solute. On the front side of a receiver sheet disposed below the transmitter sheet there is applied a receiving layer of so-called CF (coated front) substances, which commonly consists of active adsorbents and inorganic and/or organic color developers.

On writing or printing upon such a copy form set the microcapsules of the CB layer are caused to burst in the area which is written or printed upon, so that the CB substances of the transmitter sheet can mix up with the facing CF substances of the receiver sheet. This results in the desired copy face on the receiver side of the receiver sheet.

For most of the applications the copy produced by commercial color reaction paper is sufficient even though it is often relatively weak and without sharp contours. In other applications, which are referred to further in detail hereinafter, an intensified copy is required or desired.

SUMMARY OF THE INVENTION

It is the object of this invention to improve the color intensity of the copy of the copy form set and to provide sharp contours.

According to the present invention this object is substantially achieved in that the transmitter side of the transmitter sheet comprises a structure which under the application of pressure delivers an oily solvent/dye mixture which contains dye precursors and usual dyes or pigments to be adsorbed by the adsorbing and color-developing CF layer of the receiver side of the receiver sheet. In order to achieve this result, the following possibilities are available:

(a) Commercial color reaction papers provided with an additional non-encapsulated layer. Herefor the CFR paper may be purchased completely as standard provided already with a microcapsule CB layer. The additional layer may be applied in the printing process inline without substantial additional costs, especially when the layer is applied zonewise.

(a1) hot melt application (solid mass which is applied in the molten condition and solidifies immediately)

(a2) "printing ink" application at normal temperature or slightly heated (liquid to pasty mass which solidifies upon application).

(b) microencapsulated dyes or inks in addition to the usual CB layer:

(b1) extra applied as a second layer (b2) mixed with the capsules of the dye precursors in one layer (b3) dyes and dye precursors mixed together in the same capsule.

In the methods (b1), (b2), (b3) the application is carried out according to known coating techniques preferably in aqueous systems on coating or spreading machines.

The methods (a1), (a2), and (b1) allow an advantageous zonewise and limited application of the intensification layer.

In the case of the present invention the copying act results on the one hand in the usual color development caused by the mixing of the CB and CF substances, and the copy based thereupon is on the other hand further intensified due to the dyes which are transmitted as defined by the typeface on the receiver side of the receiver sheet.

The solvent which is present in the CB microcapsules favors the detachment of the additional ink layer from the transmitter sheet, and the adsorbents of the CF layer favor the ink pick up by the receiver sheet (option (a), both methods).

According to an advantageous embodiment of the invention provision is made that the additional ink layer is applied on the transmitter side only zonewise. For many cases of use such partial application of an additional ink layer will be completely sufficient, particularly in those cases when the legibility on the receiver sheet is sufficient on the whole, but nevertheless certain information is to be stressed or pointed out. In this connection the following cases of application are to be mentioned:

The only partial and zonewise application of an additional ink layer is expedient in forms in which the duplicate voucher (CF sheet) is subsequently coded with certain data by the data typist. The characters which are relevant for the coding should be extremely well legible and furthermore stressed or pointed out over the remaining copied text. Thus, it will be sufficient when the copy results of the entire form satisfy usual standard requirements, while individual parts of the copy as produced stand out for faster and safe registration by the data typist. An example hereof are the credit vouchers (receipts) of bank remittances.

Zonewise applied additional ink layers are expedient also in such forms in which sections of the copies are to be read optically by machines. The copy contrast which is produced by common color reaction papers is clear enough for the human eye, but it is often too weak for OCR readers. An example of such a case are credit card form sets. Further, for example in cases of particular requirements for microfilm recording, additional ink layers applied partially zonewise according to the invention may be appropriate.

Preferably, the transmitter sheet is provided with a self-reacting ink layer on the side which is adapted to be written upon, and depending on the case of use it may then serve as first sheet or as intermediate sheet, or it is provided with a receiving layer and hence serves as intermediate sheet.

According to the invention provisions are made that the additional ink layer is partially or completely soluble due to the CB substances contained in the dye precursor microcapsules. In this way it can be ensured on one hand that the additional ink layer is sufficiently solid in order to prevent it from being inadvertently wiped off or blurred, and on the other hand it can be ensured that the additional ink layer is safely detached within the area of the writing which is to be transmitted. Though the additional ink layer is in solid form, it is chemically related to the solvents of the capsules. Therefore, firstly the capsules are not attacked by the additional ink layer since they are not attacked by their own solvent, and secondly the additional ink layer is completely dissolved by the solvent of the capsules when pressure is applied ("like materials dissolve each other"):

It is preferred to select the composition of the additional ink layer such that it does not affect or attack the dye precursor microcapsules. If however, according to another preferred embodiment of the invention, the additional ink layer comprises microencapsulated dyes, there is no need to give consideration to a possible softening-up of the dye precursor microcapsules by the dye, because in this case the materials of the ink layer are not directly contacted with the microcapsules of the dye precursors and other appropriate materials may be selected for the microcapsules of the dye (option (b)).

The microcapsules of the dyes may be mixed with the microcapsules of the dye precursors, or the microcapsules of the dye precursors and the microcapsules of the additional ink layer may be arranged as superposed layers, in which case the additional ink layer is preferably arranged on the outside.

In an alternative embodiment of the invention it may also be suitable that the color intensification is achieved by using dyes which are not encapsulated in particular microcapsules, but rather contained in the microcapsules of the dye precursors, and in such case the dyes are preferably soluble, almost soluble or pigmented, and present in the same oily solvent.

Suitable ink layers (in method (a1)) proved to be above all formulations with wax or wax-like materials which are solid in the cold state, applied preferably in the molten state (approximately between 50° and 110° C.) and solidify immediately upon chilling. Preferably the ink layer may contain various natural and synthetical waxes, suitable plasticizers, paraffins, weakly drying oils such as spindle oil, as well as dye pigments such as soot and optionally also white pigments and/or metal powder such as e.g. aluminium.

In an alternative embodiment of the invention, method (a2) offers also the possibility of using ink layers of the kind of the known various printing inks, which are liquid to pasty, can be applied in a condition ranging from cold to slightly heated, may contain wax, however do not harden or set too much, and may be partially dissolved after the drying of still oily materials of the CB substances. Suitable binding agents herefor are polyglycols or like materials. Further, such ink layers contain weakly drying oils and dye pigments and optionally a selection of slightly hardening resins as well as plasticizers and antioxydants if required.

It turned out that on using the invention also additional ink layers lead to the desired result, which otherwise show a low copying effect on usual papers. The solvent in the microcapsules initiates the dissolution of also somewhat harder ink layers, transmitting them together with the dye precursors on the receiver sheet. This results in a synergistic effect since also the common receiving layers of CFR papers (chemically reacting color reaction papers) intensively adsorb the ink layer.

Another advantage of the invention resides in that commercially available CFR papers may be used which can then be further improved by partial and zonewise application of the ink layer, something that is technically simple and inexpensive in the printing process inline.

During the copying operation the CB substances in the copy zones are set free, and a mixture of dissolved dye precursors and dye pigments is jointly soaked up by the CF layer of the receiver sheet. The dye pigments deposit not only on the surface of the receiver sheet, but they are also retained in the depressions, recesses and cavities of the CF layer which primarily consists of clay particles and has a specifically fissured and large surface. The solvents of the CB substances are partially the same or of similar kind as the oils, waxes and paraffins of the additional ink layer. Therefore the additional ink layer need not be a typical copying ink. Particularly the liquid contents of the CB microcapsules may be similar to the composition of the additional ink, however as solid mass and enriched with pigments. The additional ink of the ink layer, though having low copying properties, is transmitted to the receiver sheet to a surprisingly high extent, after it has been partially or completely dissolved by the solvent contained in the CB capsules and then transmitted as a solution mixture of dye precursors and dyes to the strongly adsorbing CF layer. Due to the additional color development in the CF masses an extremely color-intensive copy is obtained.

Another essential advantage of the invention resides in that not only the copy is intensified, but also the fidelity of the copied type-face or letters is improved in the marginal area thereof because due to the pressure of the printing letters or of other recording instruments the dye pigments concentrate particularly intensively in the marginal area of the printing face, whereby a certain unsharpness of the copy of usual color reaction papers is improved.

Suitable CB papers as transmitter sheets and CF-coated papers as receiver sheets are known to those skilled in the art.

The commercially available color reaction paper, upon which subsequently the additional ink layer is applied in particular partially and zonewise, may be composed as follows:

I. The CB coating consists of microcapsules, binding agents and additives to prevent too early undesired coloration.

(a) The capsules are made of 1. the wall material: gelatine, polyester, polyamide, polyurethane, and other plastic materials, preferably of polyurea.

2. the capsule contents: high-boiling oils which are the most color- and odorless possible, and solvents and diluents such as e.g. alkyl benzenes, chloroparaffins, isopropyl naphthalines, paraffins, kerosene, spindle oil. Therein solute are so-called leuco dyes such as crystal violet lactone, malachite green lactone, benzoyl leucomethylene blue, rhodamine-B.-lactam, leuco auramine and the like. Further, the following dye precursor groups may be possible: indolyl phthalides, fluoranes, spiropyranes, azomethines, phenothiazines and the like.

(b) The binding agents for the capsule mass are plastic binding agents commonly used in the paper industry, e.g. polyvinyl alcohol, polymer latices and starch binders.

(c) The following additives may be used: natural materials such as cellulose powder and starch granules, inert inorganic and organic pigments.

II. The CF coating consists mainly of active clay e.g. of the attapulgite type, preferably however of the montmorillonite type, to which zinc salts and adsorbents with or without color-developing properties may be added (e.g. calcium carbonate, alumina, silicic acid, zinc oxide, lithopone, titanium oxide and the like).

Possible are also coatings on the basis of color developing phenol compounds and salicylates, also zinc-modified, as well as the resins thereof, which may be used together with white pigments. The binding agents for the CF layers are the usual paper coating binders (see (b)), unless other color-developing resins are already used as binding agents.

BRIEF DESCRIPTION OF THE DRAWINGS

An embodiment of the invention (according to option (a) or (b)) is hereinafter described, reference being had to the accompanying drawing.

DETAILED DESCRIPTION OF A PREFERRED EMBODIMENT

Figures 1, 2:
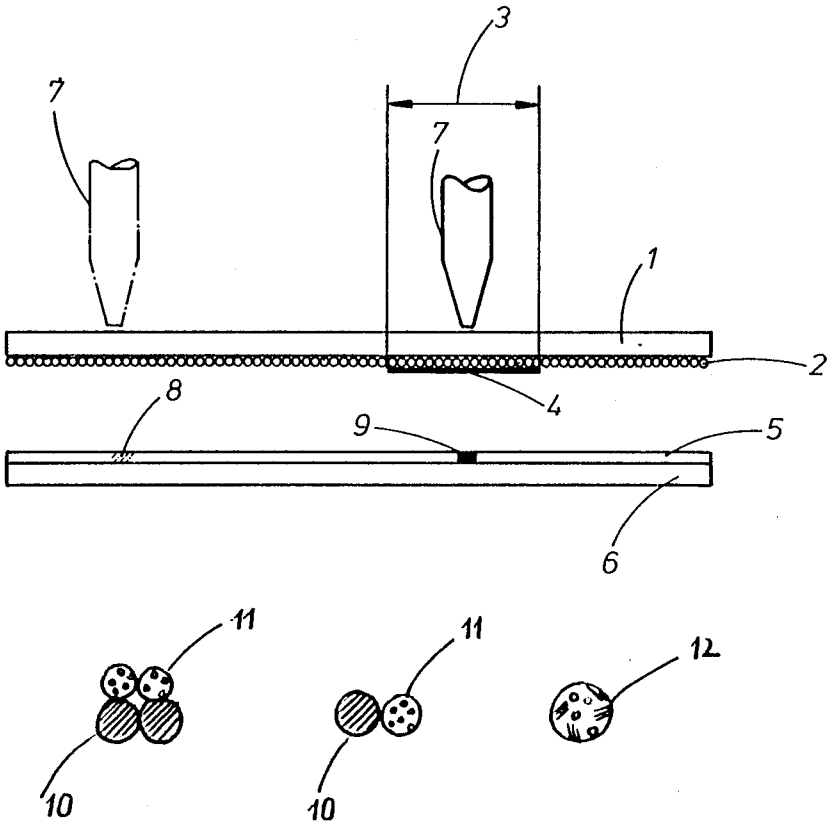
FIG. 1 is a largely schematized view of a section taken through a copy form set.
FIG. 2 is a largely schematized representation of the coating structure of the transmitter sheet in various alternatives.

The copy form set as shown comprises an upwardly lying transmitter sheet 1 and a receiver sheet 6 disposed therebeneath. The lower side of the transmitter sheet 1 has a usual CB coating 2 in the form of microcapsules. On the facing upper side of the receiver sheet 6 there is arranged a usual CF coating 5. In the area of the intensification zone 3 of the copy form set the additional ink layer 4 is applied by hot melt application in an amount of 5 g/m$^2$ on the lower side of the transmitter sheet 1 or the CB coating 2 respectively. When the copy form set is written or printed upon outside the intensification zone 3 as shown by the dash-lined position of the recording instrument 7, then the usual chemical reaction between the CB coating and the CF coating takes place, resulting in a relatively weak copy which is shown in the Figure by the reference numeral 8. When, however, the paper is written upon within the area of the intensification zone 3, then besides the usual chemical reaction taking place in the written area ink is transmitted also from the additional ink layer 4 on the transmitter sheet 6, so that a duplicate copy 9 is produced which is more intensive in color and has sharper contours due to the additionally transmitted ink.

When e.g. blue-copying CFR paper is used and the CB side of the transmitter sheet 1 is covered with small ink-transmitting grey zones, then the normal text will appear blue whilst the text which is to be pointed out will be dark-grey, exhibiting a high contrast.

Measurements with a McBeth-Print-Contrast-Meter 11 in various relevant filter positions provided the following results on white CFR paper:

| | |
|---|---|
| Blue CFR copies | 10–28% PCS |
| Black CFR copies | 14–68% PCS |
| Intensified copies according to the invention | 72–84% PCS |

Intensity of the copy:

Measured with apparatus PCM II, 1520B, of the company Kollmorgen AG, CH-6300 Zug (Switzerland), PCS value (printing contrast) in percent, calculated according to the formula $$\frac{Rp - Ri}{Rp} \times 100$$

(Rp=reflection paper, Ri=reflection copy or imitation), filter which practically covers all spectral regions of hitherto known optical reading instruments, as stated by the company Kollmorgen AG:

A=blue-green
B=tungsten silicone
C=tungsten silicone without visual share
D=905 nm
E=633 nm (HeNe laser)
F=tungsten silicone plus OG 590 plus Calflex X

| | normal CFR copy | | according to method (al) color intensified copy | |
|---|---|---|---|---|
| Filter | brightness paper | PCS | brightness paper | PCS |
| A | 84% | 68% | 81% | 83% |
| B | 82% | 21% | 80% | 79% |
| C | 84% | 16% | 80% | 75% |
| D | 82% | 14% | 79% | 71% |
| E | 84% | 65% | 80% | 84% |
| F | 84% | 18% | 80% | 72% |

A conspicuous increase of the PCS value due to the color intensification can be observed.

Intensity loss after 18 days of artificial aging at 58° C. and 50% relative humidity:

normal CFR copy: 10.5%
color intensified copy: 9.5%

Since it is nowadays commonly accepted that copies from about 50% PCS are OCR-readable, the present invention completely meets these requirements, and smearing or insufficiently forge-proof carbon papers or the like need not be used. Due to the zonewise limited application of suitable additional ink layers 4 additionally prominent and OCR-readable copies are obtained besides the usual CFR copy.

The examples shown in FIG. 2 in a very schematized manner for a coating structure of the transmitter sheet show from left to right:

an arrangement of the hatched (dark) microencapsulated dyes 10 under the microencapsulated dye precursors 11;

an arrangement of the capsules substantially beside each other in a layer; and dyes and dye precursors in a microcapsule 12.

I claim:

1. Copy form set which comprises, a transmitter sheet whose transmitter side is provided with a layer of microencapsulated dye precursors (CB substances), as well as a receiver sheet whose receiver side facing the transmitter side of the transmitter sheet is provided with color-developing adsorbing substances (CF substances), characterized in that the transmitter side of the transmitter sheet comprises an additional ink layer over said CB substances opposite said transmitter sheet which is adapted to be transmitted during the copying act on the receiver side of the receiver sheet in order to reinforce the writing on the receiver side.

2. Copy form set according to claim 1, characterized in that the additional ink layer is applied on the transmitter side only zonewise.

3. Copy form set according to claim 1 characterized in that the side of the transmitter sheet which is adapted to be written upon is provided with a self-reacting ink layer (SC-CB).

4. Copy form set according to claim 1 characterized in that the side of the transmitter sheet which is adapted to be written upon is provided with a receiving layer (CFB).

5. Copy form set according to claim 4 characterized in that the additional ink layer is completely or partially soluble by the substances contained in the dye precursor microcapsules.

6. Copy form set according to claim 5, characterized in that the additional ink layer does not dissolve the dye precursor microcapsules.

7. Copy form set according to claim 6, characterized in that the additional ink layer contains oils or waxes as well as dyes or pigments.

8. Copy form set according to claim 7 characterized in that the additional ink layer contains a small amount of plasticizer.

9. Copy form set according to claim 7, characterized in that the ink layer contains white pigments and/or metal powder.

10. Copy form set according to claim 7 characterized in that the additional ink layer is applied in a hot melting process.

11. Copy form set according to claim 3, characterized in that the additional ink layer does not completely dry.

12. Copy form set according to claim 11, characterized in that the additional ink layer is applied at least at room temperature or in a slightly heated condition.

13. Transmitter sheet, particularly for copy form sets and the like, whose transmitter side is provided with a layer of microencapsulated dye precursors (CB substances) characterized in that on the transmitter side of the transmitter sheet there is applied an additional ink layer on said layer of microencapsulated dye precursors which is adapted to be transmitted during the copying act on a receiver side of a receiver sheet in order to reinforce the writing on the receiver side.

* * * * *

UNITED STATES PATENT AND TRADEMARK OFFICE

CERTIFICATE OF CORRECTION

PATENT NO. : 4,952,551

DATED : 8/28/90

INVENTOR(S) : Walter Buehler

It is certified that error appears in the above-identified patent and that said Letters Patent is hereby corrected as shown below:

ON THE TITLE PAGE:

IN FOREIGN APPLICATION PRIORITY DATA:

Please delete "87 05 322 [UM]" and insert --68705322.5[UM]--.

IN REFERENCES CITED:

Please delete "Mowsy" and insert -- Mowry --.

Column 4, line 48, please delete "CB coating" and insert -- CB coating --.

Column 5, line 4, please delete "CF coating" and insert -- CF coating --.

Column 5, line 59, please delete "11" and insert -- II --.

Column 8, line 7, please delete "Claim 3" and insert -- Claim 1 --.

Signed and Sealed this

Fourth Day of February, 1992

*Attest:*

HARRY F. MANBECK, JR.

*Attesting Officer*

*Commissioner of Patents and Trademarks*